US006002310A

United States Patent [19]

Kich et al.

[11] Patent Number: 6,002,310

[45] Date of Patent: Dec. 14, 1999

[54] RESONATOR CAVITY END WALL ASSEMBLY

[75] Inventors: Rolf Kich, Redondo Beach; Daniel B. Goetschel, Hawthorne; Devon J. Gray, Torrance, all of Calif.

[73] Assignee: Hughes Electronics Corporation, Los Angeles, Calif.

[21] Appl. No.: 09/032,406

[22] Filed: Feb. 27, 1998

[51] Int. Cl.[6] ..... H01P 7/06; H01P 1/30

[52] U.S. Cl. ..... 333/208; 333/229; 333/234

[58] Field of Search ..... 333/208, 209, 333/212, 229, 234

[56] References Cited

U.S. PATENT DOCUMENTS

| | | | |
|---|---|---|---|
| 3,063,030 | 11/1962 | Manahan et al. | 333/229 |
| 4,488,132 | 12/1984 | Collins et al. | 333/229 |
| 4,677,403 | 6/1987 | Kich | 333/229 |
| 5,309,129 | 5/1994 | Arnold et al. | 33/229 |
| 5,867,077 | 2/1999 | Lundquist | 333/229 X |

FOREIGN PATENT DOCUMENTS

| | | | |
|---|---|---|---|
| 4113302 A1 | 10/1992 | Germany | 333/229 |

*Primary Examiner*—Seungsook Ham

*Attorney, Agent, or Firm*—Terje Gudmestad; Georgann S. Grunebach; Michael W. Sales

[57] ABSTRACT

An electromagnetic resonator comprises a waveguide body having a generally tubular side wall and a pair of end wall assemblies. The end wall assembly includes a bowed aluminum plate and an INVAR disk, attached to one another at the periphery thereof. The INVAR disk includes a relatively thick outer annular portion and a relatively thin inner circular portion. The bowed aluminum plate bows in response to increased temperature, thereby counteracting expansion of the waveguide body.

16 Claims, 2 Drawing Sheets

RESONATOR CAVITY END WALL ASSEMBLY

BACKGROUND OF THE INVENTION

1. Field of the Invention

This invention relates to thermal stabilization of a single cavity structure, or a multiple cavity structure (wherein cylindrical cavities are arranged coaxially in tandem, as in the construction of a microwave filter of plural resonant chambers, or cavities), and, more particularly, to an arrangement of one or more cavities employing at least one traverse bowed end well including materials with differing coefficients of thermal expansion to provide selected ratios of thermally induced deformation of the end wall to counteract changes in resonance induced by thermal expansion/contraction of an outer cylindrical wall of the cavity structure.

2. Description of Related Art

Cavity structures are employed for microwave filters. As is known in the art, a cavity resonator is, in effect, a tuned circuit which is utilized to filter electromagnetic signals of unwanted frequencies from input electromagnetic energy and to output signals having a preselected bandwidth centered about one or more resonant frequencies. A cavity which is frequently employed for a cavity resonator has the shape of a right circular cylinder wherein the diameter and the height (or the axial length) of the cavity together determine the value of a resonant frequency. For filters described mathematically as multiple pole filters, it is common practice to provide a cylindrical housing with transverse disc shaped partitions or walls defining the individual cavities. Irises in the partitions provide for coupling of desired modes of electromagnetic waves between the cavities to provide a desired filter function or response.

A problem arises in that changes in environmental temperature induce changes in the dimensions of the filter with a consequent shift in the resonant frequency of each filter section. Because the resonant frequency associated with each cavity is a function of the cavity's dimensions, an increase in temperature will cause dimensional changes in the cavity and, therefore, temperature-induced changes in the resonant frequency associated with the cavity. Specifically, an increasing temperature will cause thermal expansion of the waveguide body to enlarge the cavity both axially and transversely.

A filter fabricated of aluminum undergoes substantial dimensional changes as compared to a filter constructed of invar nickel-steel alloy (herein referred to as "INVAR") due to the much larger thermal coefficient of expansion for aluminum as compared to INVAR. However, it is often the case that aluminum is nevertheless a preferable material for constructing filters, especially for aerospace applications, due to its lower density, as well as its greater ability to dissipate heat, as compared to that of INVAR.

A solution to the foregoing problem, useful especially for a two-cavity filter, is presented in U.S. Pat. No. 4,677,403 of Kich (hereinafter, "the '403 patent"), the entirety of which is hereby incorporated by reference. Therein, an end wall of each cavity is formed of a bowed disc, while a central wall having an iris for coupling electromagnetic energy has a planar form. An increase of temperature enlarges the diameter of each cavity, and also increases the bowing of the end walls, with a consequent reduction in the axial length of each cavity. The resonant frequency shift associated with the increased diameter is counterbalanced by the shift associated with the decrease in length. Similar compensation occurs during a reduction in temperature wherein the diameter decreases and the length increases.

Another approach is presented in U.S. Pat. No. 5,374,911 of Kich et al. (hereinafter, "the '911 patent"), the entirety of which is hereby incorporated by reference, and which discloses a cylindrical filter structure of multiple cavities with a succession of transverse walls defining the cavities. Selected ones of the transverse walls provide for thermal compensation. Each of the selected transverse walls is fabricated of a bowed disc encircled by a ring formed of material of lower thermal expansion coefficient than the material of the transverse wall. Inner ones of the transverse walls are provided with irises for coupling electromagnetic power between successive ones of the cavities. By varying the composition of the rings to attain differing coefficients of thermal expansion within the rings, different amounts of bowing occur in the corresponding transverse discs with changes in temperature. Thus, the ring of an inner transverse wall has a relatively large coefficient of thermal expansion as compared to the ring of an outer one of the transverse walls, resulting in a lesser amount of bowing of the inner wall and a larger amount of bowing of the outer wall with increase in environmental temperature and temperature of the filter.

In a preferred embodiment disclosed in the '911 patent, the housing is constructed of aluminum, as is a central planar transverse wall having a coupling iris. The other transverse walls, both to the right and to the left of the central wall, are provided with a bowed structure, the bowed walls being encircled by metallic rings. The inboard rings nearest the central wall are fabricated of titanium, and the outboard rings are fabricated of INVAR. The INVAR has a lower coefficient of thermal expansion than does the titanium and, accordingly, the peripheral portions of the outboard walls, in the case of a four-cavity structure, experience a more pronounced bowing upon a increase in environmental temperature than do the inner walls which are bounded by the titanium rings having a larger coefficient of thermal expansion.

The reason for the use of the rings of differing coefficients of thermal expansion is as follows. Deflection of an inboard wall reduces the axial length of an inner cavity, on the inner side of the wall, while increasing the axial length of an outer cavity, on the opposite side of the wall, with increasing temperature. Thus, the inboard wall acts in the correct sense to stabilize the inner cavity but in the incorrect sense for stabilization of the outer cavity. Accordingly, in stabilizing the outer cavity by means of the outer wall, it is necessary to provide an additional bowing to overcome the movement of the inboard wall, to thereby stabilize thermally the outer cavity.

One disadvantage associated with a resonator structure constructed in accordance with either the '403 patent or the '911 patent is that the relatively thin aluminum disk used for the end wall, that is capable of bowing in response to increased temperature, has a tendency to exhibit undesirable thermal gradients across the surface of the end wall, resulting in a frequency shift when RF power is applied.

Accordingly, there is a need for an electromagnetic resonator end wall assembly configured so as to minimize or eliminate the aforementioned problems.

SUMMARY OF THE INVENTION

In accordance with one aspect of the present invention, an end wall assembly for an electromagnetic filter comprises a first plate made from a material having a first coefficient of thermal expansion, and a second plate attached to the first plate and a made from a material having a second coefficient of thermal expansion substantially less than the first coefficient of thermal expansion.

Preferably, the first plate is made from aluminum and the second plate is made from INVAR. The second plate is bolted or otherwise attached to the periphery of the first plate.

In accordance with another aspect of the present invention, an electromagnetic filter comprises a resonator having a housing, including an end wall assembly. The housing defines a substantially cylindrical cavity and the end wall assembly includes a first plate adjacent to the cylindrical cavity and made from a material having a first coefficient of thermal expansion. The end wall assembly further includes a second plate attached to the first plate, the second plate having a second coefficient of thermal expansion substantially less than the first coefficient of thermal expansion.

In accordance with still another aspect of the present invention, an electromagnetic filter comprises a resonator having a housing, including an end wall assembly, the housing defining a substantially cylindrical cavity. The end wall assembly includes a first plate adjacent to the cylindrical cavity, having a periphery, and made from a material having a first coefficient of thermal expansion. The end wall assembly further includes a second plate attached to the periphery of the first plate, the second plate having a second coefficient of thermal expansion substantially less than the first coefficient of thermal expansion. The periphery of the first plate is substantially constrained from radial expansion in response to elevated temperature, the first plate is adapted to bow away from the second plate in response to elevated temperature, and the first and second plates are adapted to bend in response to elevated temperature, due to a bimetallic effect.

A resonator in accordance with the present invention has optimal thermal stability, while permitting the use of thicker aluminum plates for the end wall assembly, thereby reducing the severity of thermal gradients across the surface of the end wall assembly, and reducing resultant frequency shifts when RF power is applied.

The intention itself, together with further objects and attendant advantages, will best be understood by reference to the following detailed description, taken in conjunction with the accompanying drawings.

DESCRIPTION OF THE PREFERRED EMBODIMENTS

Figure 1:
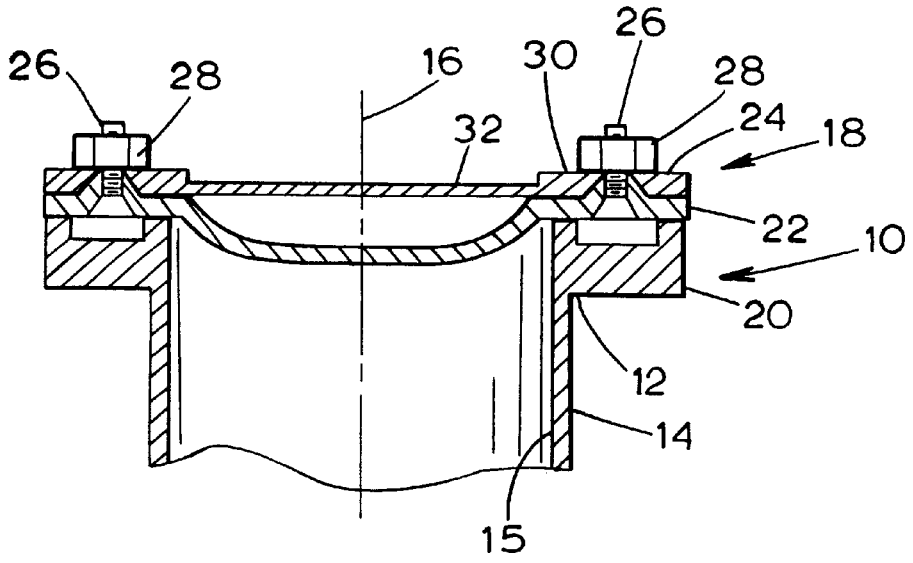
FIG. 1 is a longitudinal, fragmentary cross-sectional view of a cavity resonator with an end wall assembly in accordance with the present invention.
Figure 2:
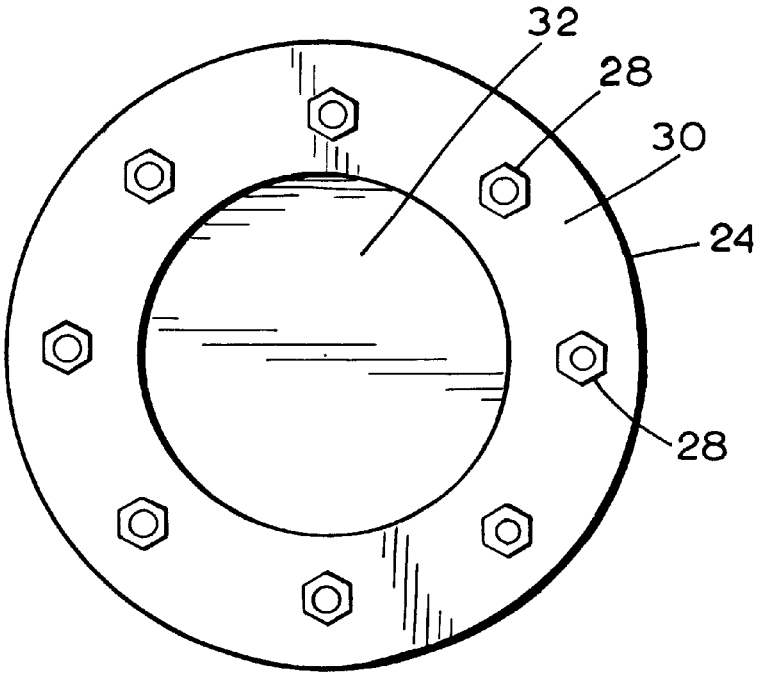
FIG. 2 is a plan view of the end wall assembly of FIG. 1.
Figure 3:
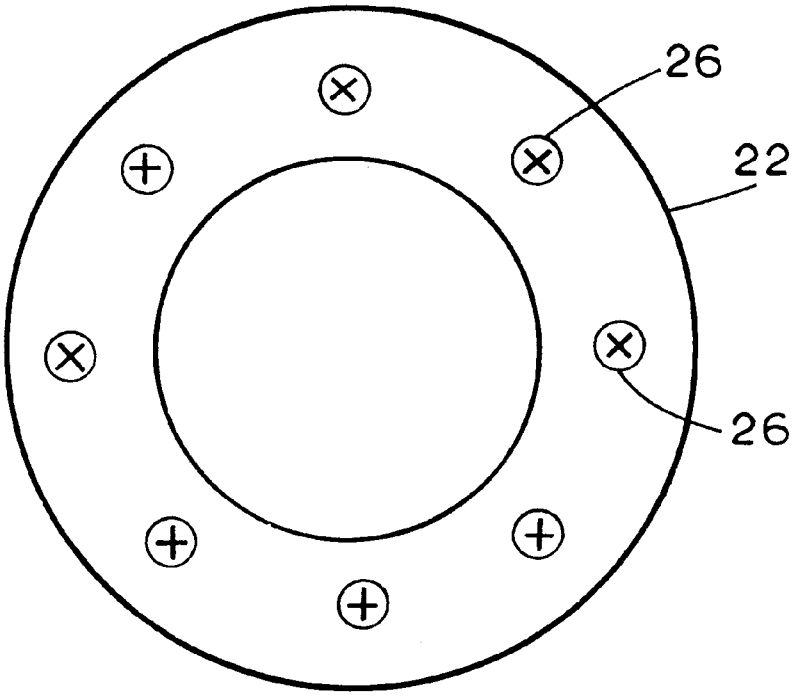
FIG. 3 is a bottom view of the end wall assembly of FIG. 1.

FIG. 1 illustrates a preferred embodiment of a cavity resonator or filter, generally indicated at 10, constructed in accordance with the present invention. The resonator 10 comprises a waveguide body 12, preferably made from aluminum and having a generally tubular sidewall 14 generally disposed about a central axis 16, and a pair of end wall assemblies, one of which is indicated generally at 18. The generally tubular sidewall 14 of the waveguide body 12 defines a substantially circular cylindrical cavity 15. The waveguide body 12 includes a flange portion 20 at either end thereof. The end wall assembly 18 is secured to the waveguide body 12 by any suitable means, such as, for example, by securing the end wall assembly 18 to the flange portion 20 using screws (not shown).

The end wall assembly 18 includes a first plate in the form of a bowed aluminum plate 22 and a second plate in the form of an INVAR disk 24. The INVAR disk 24 includes an outer annular portion 30 that is relatively thick, and an inner circular portion 32 that is relatively thin. The bowed aluminum plate 22 is attached at the periphery thereof to the outer annular portion 30 of the INVAR disk 24 by means of bolts 26 and nuts 28. Attachment of the bowed aluminum plate 22 to the outer annular portion 30 of the INVAR disk 24 can be accomplished alternatively by way of diffusion bonding, eutectic soldering/brazing, friction welding or welding, by way of example.

Figure 4:
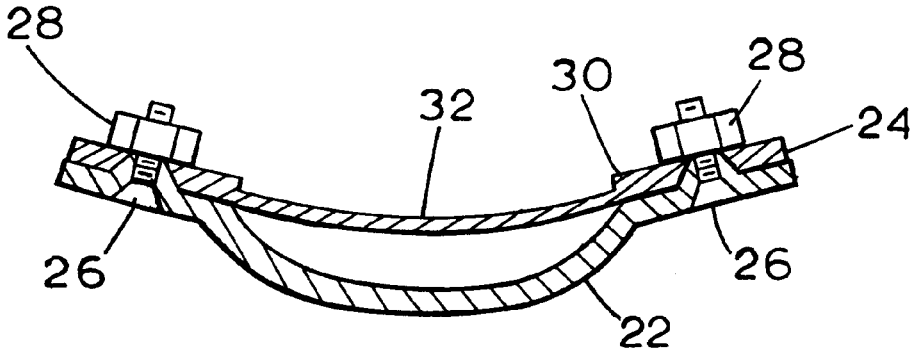
FIG. 4 is a cross-sectional view, similar to that of FIG. 1, showing the end wall assembly at an elevated temperature.

The configuration of the end wall assembly 18 at an elevated temperature is shown in FIG. 4. The bowed aluminum plate 22 has a coefficient of thermal expansion which is higher (by a multiplicative factor of about ten) than the coefficient of thermal expansion of the INVAR disk 24. As a result of the attachment of the periphery of the bowed aluminum plate 22 to the outer annular portion 30 of the INVAR disk 24, the peripheral region of the bowed aluminum plate 22 is allowed to expand only slightly with increasing environmental temperature, while the central portion of the bowed aluminum plate 22 is free to expand with a resultant increased bowing of the bowed aluminum plate 22 due to an "oil can" effect. This increased bowing of the bowed aluminum plate 22 is enhanced by the ability of the INVAR disk 24 to also bend due to a thermally-induced bending moment resulting from the difference in the coefficients of thermal expansion as between the INVAR disk 24 and the bowed aluminum plate 22 (i.e., bimetallic effect).

Because of this enhanced bowing of the bowed aluminum plate 22, the bowed aluminum plate 22 can have a greater thickness (i.e., increased by approximately 100%), as compared to the thickness that would be required if the bowed aluminum plate 22 were attached to an INVAR or titanium ring (as in the Kich et al. '911 patent), thus reducing the severity of thermal gradients across the surface of the end wall assembly, and reducing resultant frequency shifts when RF power is applied. The resonator 10 constructed in accordance with the present invention can maintain an overall effective coefficient of thermal expansion for the cavity 15 that is approximately one-third of that of a resonator made entirely of INVAR.

The reverse effect, with reduced bowing of the bowed aluminum plate 22, occurs upon a reduction in the environmental temperature. Although the outer annular portion 30 of the INVAR disk 24 is thicker than the inner circular portion 32, the outer annular portion 30 is substantially thinner than the INVAR ring disclosed in the rich et al. '191 patent.

Cavity resonators employing two or more cavities are well known and are within the purview of the invention. Such resonators employ the appropriate number of coupling irises to effectively divide the housing interior into the desired number of appropriately dimensioned cavities.

While the present invention has been described with reference to specific examples, which are intended to be illustrative only, and not to be limiting of the invention, it will be apparent to those of ordinary skill in the art that changes, additions and/or deletions may be made to the disclosed embodiments without departing from the spirit and scope of the invention. For example, the shape of the cavity 15 can be rectangular or elliptical in cross-section, rather than circular without departing from the spirit and scope of the invention.

What is claimed is:

1. An end wall assembly for an electromagnetic filter having a waveguide body (12), the end wall assembly comprising:

a first plate made from a material having a first coefficient of thermal expansion;

a second plate directly attached to the first plate and made from a material having a second coefficient of thermal expansion substantially less than the first coefficient of thermal expansion, the second plate including an outer annular portion and an inner circular portion, wherein the outer annular portion is thicker than the inner circular portion; and the first plate and the second plate being secured to the waveguide body.

2. The end wall assembly of claim 1, wherein the first plate is made from aluminum.

3. The end wall assembly of claim 1, wherein the second plate is made from INVAR.

4. The end wall assembly of claim 1, wherein the second plate is bolted to the periphery of the first plate.

5. The end wall assembly of claim 1, wherein the first plate is bowed away from the second plate.

6. An electromagnetic filter comprising:

a resonator having a housing, including an end wall assembly, the housing defining a substantially cylindrical cavity;

the end wall assembly including a first plate adjacent to the cylindrical cavity and made from a material having a first coefficient of thermal expansion; and the end wall assembly further including a second plate attached to the first plate and made from a material having a second coefficient of thermal expansion substantially less than the first coefficient of thermal expansion, the second plate including an outer annular portion and an inner circular portion, wherein the outer annular portion is thicker than the inner circular portion.

7. The electromagnetic filter of claim 6, wherein the first plate is made from aluminum.

8. The electromagnetic filter of claim 6, wherein the second plate is made from INVAR.

9. The electromagnetic filter of claim 6, wherein the second plate is bolted to the periphery of the first plate.

10. The electromagnetic filter of claim 6, wherein the cavity is a substantially circular cylindrical cavity.

11. The electromagnetic filter of claim 6, wherein the first plate is bowed away from the second plate.

12. An electromagnetic filter comprising:

a resonator having a housing, including an end wall assembly, the housing defining a substantially cylindrical cavity;

the end wall assembly including a first plate adjacent to the cylindrical cavity, having a periphery, and made from a material having a first coefficient of thermal expansion; and the end wall assembly further including a second plate attached to the periphery of the first plate, the second plate having a second coefficient of thermal expansion substantially less than the first coefficient of thermal expansion; the second plate includes an outer annular portion and an inner circular portion, and wherein the outer annular portion is thicker than the inner circular portion;

wherein the periphery of the first plate is substantially constrained from radial expansion in response to elevated temperature due to the attachment of the second plate to the periphery of the first plate, the first plate is adapted to increasingly bow away from the second plate in response to elevated temperature, and the first and second plates are adapted to bend due to a bimetallic effect in response to elevated temperature.

13. The electromagnetic filter of claim 12, wherein the first plate is made from aluminum.

14. The electromagnetic filter of claim 12, wherein the second plate is made from INVAR.

15. The electromagnetic filter of claim 12, wherein the second plate is bolted to the periphery of the first plate.

16. The electromagnetic filter of claim 12, wherein the cavity is a substantially circular cylindrical cavity.

* * * * *